US009815178B2

(12) United States Patent
Busskamp

(10) Patent No.: US 9,815,178 B2
(45) Date of Patent: Nov. 14, 2017

(54) WORKING CHAMBER SYSTEM FOR THE SURFACE TREATMENT OF WORKPIECES

(75) Inventor: Bernhard Busskamp, Emsdetten (DE)

(73) Assignee: WHEELABRATOR GROUP GMBH, Metelen (DE)

( * ) Notice: Subject to any disclaimer, the term of this patent is extended or adjusted under 35 U.S.C. 154(b) by 807 days.

(21) Appl. No.: 14/126,519

(22) PCT Filed: Jun. 6, 2012

(86) PCT No.: PCT/DE2012/100172

§ 371 (c)(1),
(2), (4) Date: Apr. 7, 2014

(87) PCT Pub. No.: WO2012/171525

PCT Pub. Date: Dec. 20, 2012

(65) Prior Publication Data

US 2014/0217666 A1 Aug. 7, 2014

(30) Foreign Application Priority Data

Jun. 17, 2011 (DE) ..... 10 2011 051 168

(51) Int. Cl.
*B05B 13/04* (2006.01)
*B05B 5/08* (2006.01)
(Continued)

(52) U.S. Cl.
CPC ..... *B25B 11/00* (2013.01); *B05B 5/082* (2013.01); *B05B 13/0431* (2013.01);
(Continued)

(58) Field of Classification Search
CPC ..... B65G 25/00; B65G 25/02; B65G 25/04; B65G 47/82; B05C 13/00; B05C 13/02;
(Continued)

(56) References Cited

U.S. PATENT DOCUMENTS 2,250,500 A * 7/1941 Rosenberger ..... B24C 3/083 451/37
2,514,923 A * 7/1950 Batina ..... C25D 17/08 204/222

(Continued)

FOREIGN PATENT DOCUMENTS

DE 2747107 A1 10/1977
JP 2008214067 A 9/2008

OTHER PUBLICATIONS

Wheelabrator Module 8 New Generation; Youtube address: https://www.youtube.com/watch?v=QVLghRDOXzo Uploaded on Oct. 28, 2011.*

*Primary Examiner* — Larry E Waggle, Jr.
*Assistant Examiner* — Mahdi H Nejad
(74) *Attorney, Agent, or Firm* — Karl F. Milde, Jr.; Eckert Seamans Cherin & Mellott, LLC

(57) ABSTRACT

A working chamber system for the surface treatment of workpieces comprises at least one tightly closable work chamber (101), a frame-like workpiece holder (10, 20, 30) which is displaceable on a guide rail between a mounting position outside the work chamber (101) and a working position in the work chamber (101), and a manipulator which, as seen in plan view, is arranged next to a group of parallel guide rails within the work chamber (101). At least one of the workpiece holders (10, 20, 30) has an external frame (11, 21, 31), via which it is guided in the guide rails, and an internal frame (12, 22, 32) which is surrounded by the external frame (11, 21, 31) in a transporting position and which is displaceable into a position outside the main plane of the external frame (11, 21, 31) in the mounting position and/or the working position.

8 Claims, 5 Drawing Sheets

(51) Int. Cl.
*B05B 15/12* (2006.01)
*B25B 11/00* (2006.01)
*B24C 9/00* (2006.01)

(52) U.S. Cl.
CPC ..... *B05B 15/1214* (2013.01); *B05B 15/1296* (2013.01); *B24C 9/00* (2013.01); *B05B 13/0452* (2013.01); *B05B 15/1207* (2013.01)

(58) Field of Classification Search
CPC ... B05C 13/025; B05C 5/002; B05B 13/0452; B05B 5/082; B05B 13/0431; B05B 15/1296; B05B 15/1214; B25B 11/00
USPC ..... 198/468.01, 468.6, 750.2; 118/315–317, 118/324, 326, 500, 503, 323; 269/289 MR; 427/458
See application file for complete search history.

(56) References Cited

U.S. PATENT DOCUMENTS 2,544,806 A * 3/1951 Ransburg ..... B05B 5/087 118/630
3,149,445 A * 9/1964 Nolan ..... B24C 9/003 451/38
3,459,313 A * 8/1969 Brummel ..... F27D 3/0024 134/157
3,830,196 A * 8/1974 Guttman ..... B44D 3/166 118/326
5,152,839 A * 10/1992 Boyce ..... B05B 15/1211 118/309
5,417,765 A * 5/1995 Otani ..... B05B 15/1237 118/314
5,944,896 A * 8/1999 Landesman ..... B05B 13/0285 118/500
6,189,709 B1 * 2/2001 Cullen ..... B05B 5/082 211/118
6,726,548 B1 4/2004 Williams
2002/0134311 A1 * 9/2002 Yoshino ..... B05B 5/082 118/719
2005/0287306 A1 * 12/2005 Hays ..... B05B 5/081 427/458
2006/0169203 A1 * 8/2006 Ito ..... B05B 13/0221 118/326
2015/0136568 A1 * 5/2015 Matsumoto ..... B65G 35/06 198/710

* cited by examiner

WORKING CHAMBER SYSTEM FOR THE SURFACE TREATMENT OF WORKPIECES

BACKGROUND OF THE INVENTION

The invention relates to a work chamber system for the surface treatment of workpieces, comprising at least:

At least one tightly closable work chamber,

At least one frame-like workpiece holder that can be moved on a guide rail between an assembly position outside the work chamber and a work position inside the work chamber, One manipulator that, when seen in plan view, is arranged next to a group of parallel guide rails inside the work chamber.

Certain types of workpiece surface treatments must be carried out in enclosed work chambers, for example painting or treatments with abrasive blasting agents. The treatment itself is carried out by program-controlled manipulators. Due to the high operating speed of the manipulators, the cycle times are not determined by the actual treatment time, but essentially by the placement of the workpieces in the work chamber and the mounting therein.

To reduce cycle times and to achieve high system throughput, a work chamber system of the kind mentioned above and offered for sale by the applicant provides for the workpieces to be mounted in workpiece holders that are already outside the work chamber. The surface treatment in the work chamber must be interrupted only briefly to move one of the rail-guided workpiece holders with the fully treated workpieces out of the work chamber, and to bring the other workpiece holder with the prepared workpieces into it. At their respective end sides, the workpiece holders have seal plates that tightly close the passages in the work chamber as soon as a workpiece holder has arrived either in the assembly position outside the chamber or in the work position inside the chamber.

This work chamber system has basically proven itself. However, one disadvantage arises in that the workpiece holders are guided on parallel rails, with one of the rails necessarily positioned closer to the manipulator than the other. Thus, there are different distances between the manipulator head with the paint or spray nozzles and the workpieces, depending on which one of the workpiece holders happens to be in the work chamber, such that the result of the work may turn out differently as well.

Although the problem can often be solved by two guide rails in that the manipulators are used in pairs, which are each arranged on one side of the group of adjacent guide rails and work in opposite directions. These then process the front and the rear side of the workpieces alternately. However, this entails a higher cost investment.

If the manipulator is mounted stationary and has as a first axis a rotation axis without being longitudinally movable along the guide rails, then difficulties can arise for it to reach the outer areas of the work area as defined by the outer frame of the workplace holder, especially if there is a greater distance to the workpiece holder.

More than two workpiece holders are required if the cycle times of the surface treatment, as compared to the set-up times for removing and mounting of workpieces, are very short. In this case, mounting is separated from removing by using a total of three workpiece holders: A first one for mounting the raw workpieces, a second for processing in the chamber and a third for removing the finished treated workpieces outside the chamber. In this configuration, the disadvantages mentioned remain, even when using a pair of manipulators on opposite sides, because than even twice as large a distance exists between the respective outer guide rails than between two directly adjacent guide rails. Especially in tight work chambers and when using 6-axis articulated robots with their limited working space as manipulators, not all points of the work surface can be reached inside the workpiece holder, at least not at the right distance and in the required orientation of the manipulator head.

Known from U.S. Pat. No. 3,149,445 is a working chamber system with an outer frame guided on rails and being used to transfer work pieces individually or in transport boxes into the processing position.

However, this rail-like arrangement requires a large width and does not allow for prepared mounting of a workpiece in a defined position that then only needs to be moved into the work chamber.

Known from DE 27 47 107 A1 is a work chamber system, wherein the workpieces can be transferred to the processing position individually or on pallets via a roller conveyor and can be positioned inside the work chamber via a turntable. However, a frame-like arrangement, that allows the upright mounting of workpieces such that they can be placed frontally in the workspace of a manipulator, does not exist.

SUMMARY OF THE INVENTION

The objective of the present invention is therefore to improve a work chamber system of the aforementioned kind in such a way that regardless of the respective workpiece holder located in the work chamber, consistent distances can be established between the workpieces and the manipulators.

This objective is achieved according to the present invention in that at least one workpiece holder includes an outer frame, by which said workpiece holder is guided in the guide rails, and an inner frame that is surrounded by the outer frame in a transport position and can be moved, when in the assembly position and/or the working position, to a position beyond the base plane of the outer frame.

Pivoting out of the plane of the frame inside the working chamber has the advantage that the workpieces mounted in the inner frame can be moved at least to the plane of the directly adjacent guide rail.

Preferably, with a plurality of such workpiece holders that are guided on parallel rails, workpieces in a workpiece holder on the center guide rail can be relocated to the plane of an outer guide rail so that they are positioned closer to the manipulator. This is advantageous for only one-sided treatment by the manipulators on one side.

The parked position can assume a certain angle to the plane of the workpiece frame. However, positioning the inner frame in a plane-parallel position, that is exactly at the same position that an inner frame of the adjacent holder occupies, is particularly preferable. Thus, no conversions must be made for the rail in the program sequence of the manipulator.

If workpieces are treated simultaneously from two sides located opposite each other, it is advantageous to pivot the inner frame from the inserted work piece holders that have each been moved in on an outer guide rail each into the plane of the central guide rail. The workpieces are then always in the same, central plane during processing, regardless of the plane in which they were inserted into the work chamber.

Another advantage of the work chamber system according to the invention arises from the fact that the inner frames can be parked on the side outside the work chamber even during preparation and mounting. In this way, the operators can draw the inner frame closer to their own position so that they can perform the same manual steps during mounting and unclamping from the customary location.

It is particularly advantageous if the inner frame can be lowered relative to the outer frame when it is positioned outside the base plane of the outer frame, so that the operators can work in a comfortable position without steps.

It is preferably provided that the inner frame is connected pivotally via a parallelogram linkage to the outer frame. A parallelogram linkage is easy to manufacture and can be made robust. In addition, the kinematics is such that, when pivoted out of the plane of the outer frame, lowering occurs at the same time. In addition, the particular plane-parallel disengagement movement can therefore occur very quickly.

The advantages for ergonomics areas presented above. Set-up times are also improved by the fact that the inner frame can be coupled with the outer frame via a detachable connection. The operator can, for example, pivot out the inner frame and place it on a handcart. Then an inner frame can be used that has already been prepared in other work processes by other people. Populating the inner frame with workpieces, and the later removal of the finished workplaces therefrom, can thus also take place outside the actual work chamber system. Removability is advantageous also with a frequent change of workpiece types, since inner frames that have been adapted individually to the respective type of workpiece can be used.

Such a detachable connection can be effected in a structurally particularly simple manner, for example, in that the ends of the parallelogram linkages are formed as fork-shaped receptacles and in that pins that can be hung in the receptacles are provided at the vertical bars of the inner frame.

It is also advantageous if the inner frame can be rotated around a vertical axis. This can make mounting and unclamping of the workpieces outside the work chamber easier. By turning the inner frame, the respective rear side of the workpieces can also be treated by the same manipulator inside the work chamber. If the rotation of the inner frame is integrated in the program sequence of the manipulator, an additional degree of freedom is created in order to be able to reach, with the manipulator head, locations on the workpiece that are potentially difficult to access.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
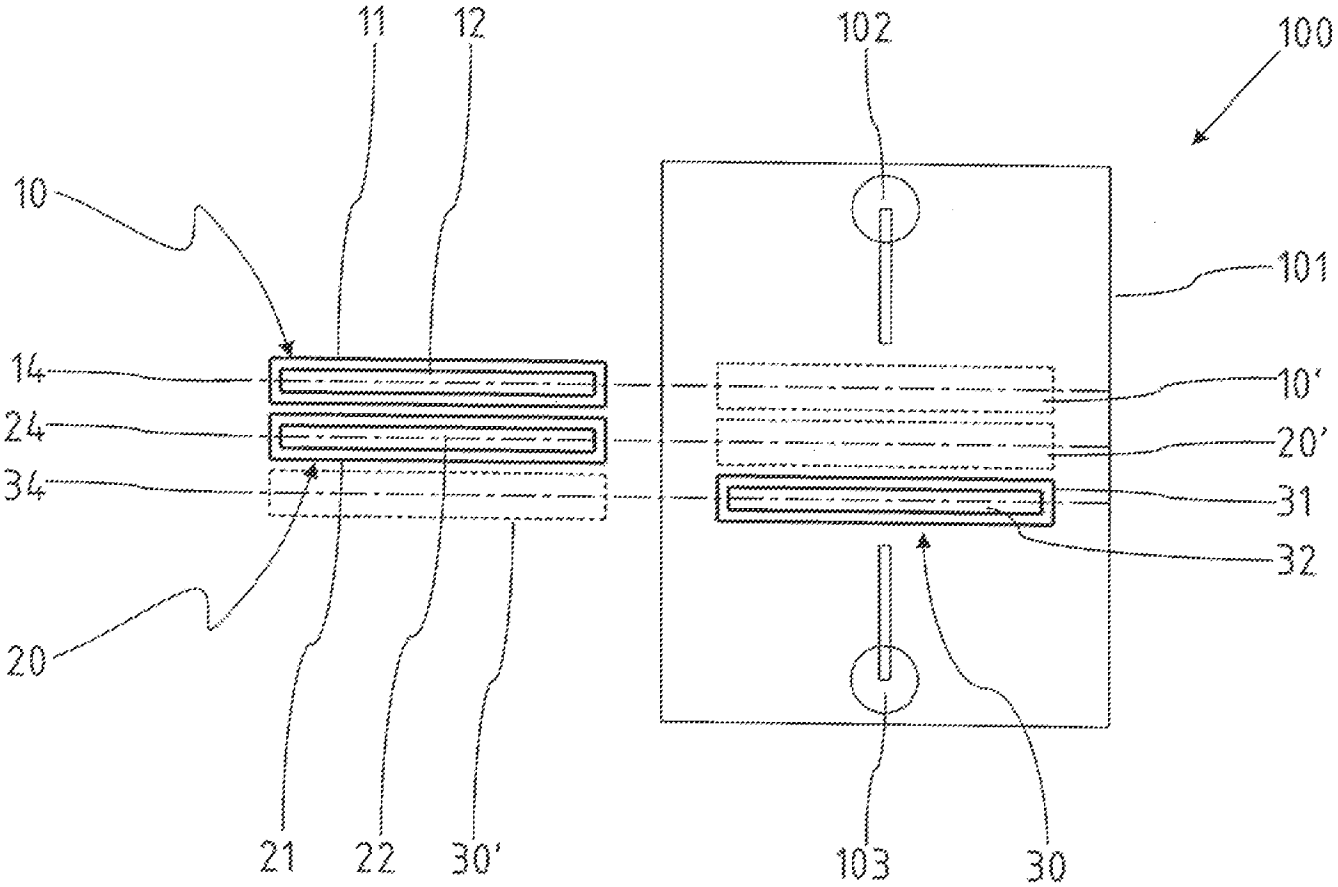
FIGS. 1 and 2 show a work chamber system in various positions of the workpiece holders, each in schematic top view.

The preferred embodiments of the present invention will now be described with reference to FIGS. 1-4 of the drawings. Identical elements in the various figures are designated with the same reference numerals.

FIG. 1 shows a top view of a work chamber system 100. Positioned inside a work chamber 101 are two manipulators 102, 103 located opposite each other. Arranged therebetween are three parallel guide rails 14, 24, 34 for the workpiece holders 10, 20, 30.

In FIG. 1, two workpiece holders 10, 20 are located outside the work chamber 101. Located inside the work chamber 101 is the workpiece holder 30 having an outer frame 31 and inner frame 32. This workpiece holder is movable on the lower guide rail 34. In FIG. 1, the free parking locations of the workpiece holders 10, 20, 30 are designated with 10', 20', 30'.

Figure 2:
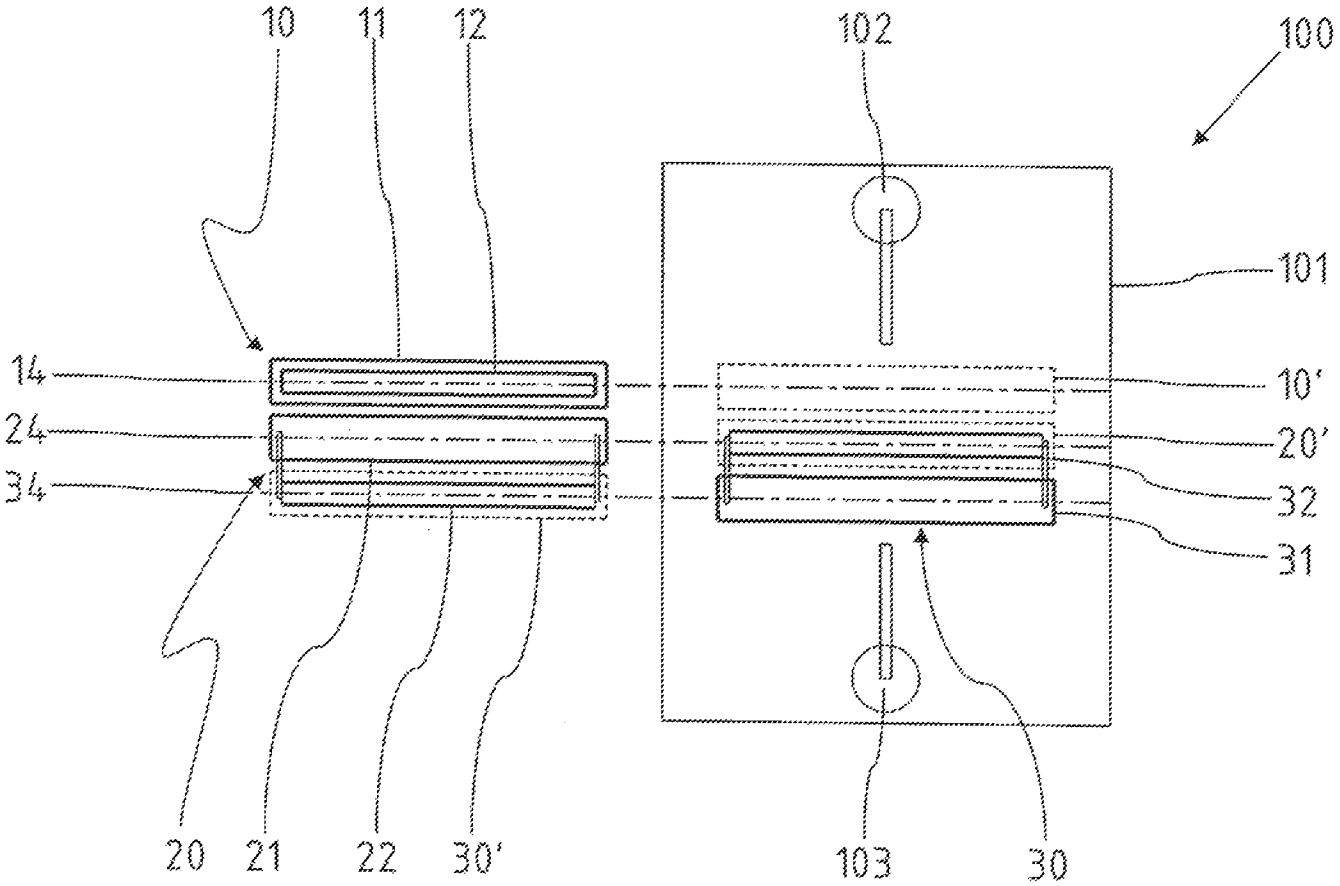

In FIG. 2, an inner frame 12 is located inside the outer frame 11 for the upper workpiece holder 10. For the middle workpiece holder 20 on the other hand, the inner frame 22 is shown pivoted out of the outer frame 21. It is then located in a parking location 30' for the lower workpiece holder 30 in the region of the lower guide rail 34. An operator can thus reach the workpieces contained therein more easily.

Inside the work chamber 101 and for the workpiece holder 30, the inner frame 22 is placed towards the center guide rail 24 such that it has the same distance to both manipulators 102 and 103. Through the open outer frame 31, the bottom manipulator 103 acts upon the workpieces in the inner frame 32.

Figure 3:
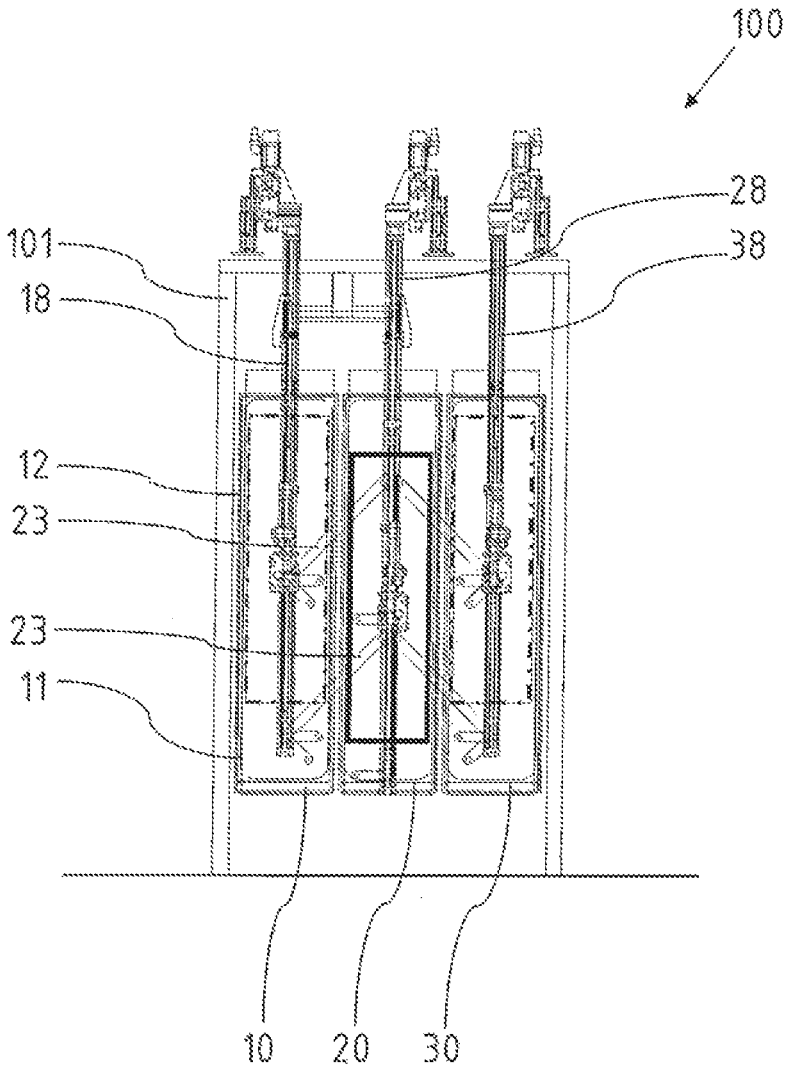
FIGS. 3 and 4 show a work chamber system in various positions of the workpiece holders, each in side view.

FIG. 3 shows the work chamber system 100 from the side, that is, from the front of the workpiece holders 10, 20, 30, so that the work chamber 101 is located in the background. All three workpiece holders 10, 20, 30 are moved out of the work chamber 101.

Clearly visible are the parallelogram linkages 23, which are mounted on the outer frame 11 of the left workpiece holder 10. Drive shafts 18, 28 and 38 are connected to the carriages of the guide rails and allow the remotely operated, motor-driven adjustment of the inner frames 12, 22, and 32 relative to the respective outer frames 11, 21 and 31.

In FIG. 3, the inner frame 12 of the left-hand workpiece holder 10 indicated by a solid line is not only moved horizontally from the starting position indicated by a dot-dash line relative to the outer frame, but is also lowered vertically relative to the starting position shown as a dot-dash line, so that it is more easily accessible for the operator.

The particular advantages of the work chamber system according to the invention are apparent from FIG. 4, which again shows a side view. The work chamber 101 can be seen in the background. At the passages located there, the workpiece holders 10, 20, 30 have sealing plates 16, 26, 36, that rest against the passages from the inside and close them as soon as the workpiece holders have been pulled or moved outward.

For the each of the workpiece holders 10 and 30 positioned at the outer guide rails, the inner frames 12 and 32 have been moved from their starting points, indicated by a dash-dot line, outward to the side and at the same time vertically downward using the parallelogram linkages 13 and 33. This allows the operators 106, 107 to place the inner frames 12, 32 on hand carts 104, 105 or the like and to entirely remove the workpiece holders 10, 30 by loosening the connection to the parallelogram linkages 13, 33.

Figure 4:
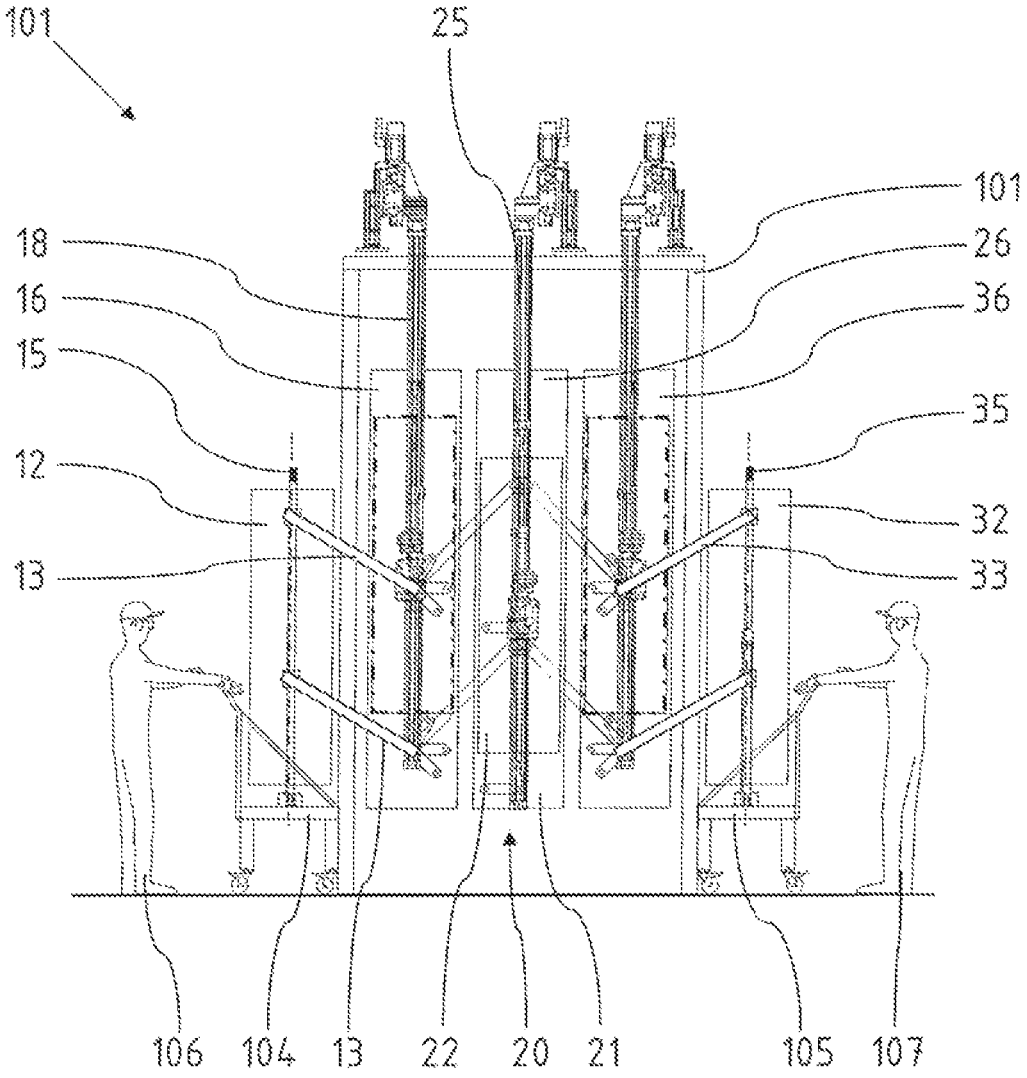

Recognizable in FIG. 4 are also vertical axes 15, 25, 35 of the workpiece holders 10, 20, 30, respectively, which allow for rotation of the inner frames 12, 22, 32.

Figure 5:
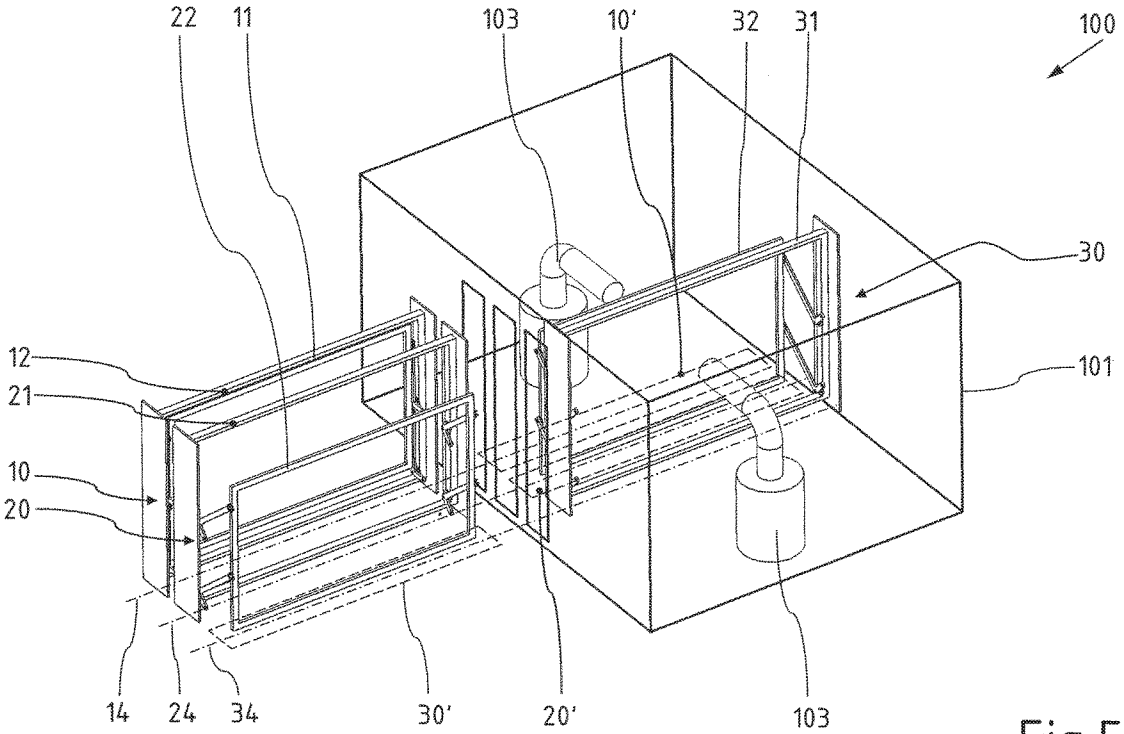
FIG. 5 is a perspective and partially phantom view of the work chamber system shown in FIGS. 1-4.

FIG. 5 is a perspective view, shown partially in phantom, showing the various elements of the work chamber system that are illustrated in top and side views, respectively, in FIGS. 1-4.

There has thus been shown and described a novel working chamber system for the surface treatment of workpieces which fulfills all the objects and advantages sought therefor.

Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A work chamber system for surface treatment of workpieces, said system comprising in combination:

a tightly closable work chamber;

at least two frame-shaped workpiece holders;

at least one guide rail associated with each of said at least two workpiece holders configured to guide movement of its respective workpiece holder between an assembly position outside the work chamber and a working position inside the work chamber; and at least one manipulator that, when viewed in plan view, is arranged next to a plurality of parallel guide rails inside said work chamber;

wherein each of said at workpiece holders includes an outer frame, by which it is guided on its respective at least one guide rail, and an inner frame that is surrounded in a transport position by its outer frame and that is movable relative to its outer frame, in at least one of the assembly position and the working position, to a plane-parallel position outside of a base plane of its outer frame.

2. The work chamber system as in claim 1, wherein the at least two frame-shaped workpiece holders are vertically oriented, each configured to be moved along an associated said at least one guide rail between the assembly position outside of the work chamber and the working position inside the work chamber, and wherein the at least one guide rail of each of the at least two workpiece holders are arranged parallel to each other.

3. The work chamber system as in claim 1, wherein the inner frame is configured to be lowered outside the base plane of the outer frame relative to the outer frame.

4. The work chamber system as in claim 1, wherein the inner frame is connected pivotally to the outer frame via a parallelogram linkage.

5. The work chamber system as in claim 4, wherein ends of the parallelogram linkage are constructed as fork-shaped receptacles, and wherein pins are provided at vertical bars of the inner frame configured to be hung in the receptacles.

6. The work chamber system as in claim 1, wherein the inner frame is configured to be coupled with the outer frame via a detachable connection.

7. The work chamber system as in claim 1, wherein three workpiece holders are provided and arranged in parallel, wherein at least outer ones thereof are provided with inner frames that can be moved and parked toward an outside of the work chamber.

8. The work chamber system as in claim 1, wherein the inner frame of the workpiece holder is rotatably supported on its outer frame about at least one axis.

* * * * *